US009328952B2

(12) United States Patent
Liao

(10) Patent No.: US 9,328,952 B2
(45) Date of Patent: May 3, 2016

(54) REFRIGERATING MACHINE HAVING TUBE-COOLED EVAPORATOR AND AIR-COOLED EVAPORATOR

(71) Applicant: Jung-Shen Liao, Chia Yi (TW)

(72) Inventor: Jung-Shen Liao, Chia Yi (TW)

( * ) Notice: Subject to any disclaimer, the term of this patent is extended or adjusted under 35 U.S.C. 154(b) by 458 days.

(21) Appl. No.: 13/966,618

(22) Filed: Aug. 14, 2013

(65) Prior Publication Data

US 2015/0047380 A1 Feb. 19, 2015

(51) Int. Cl.
*F25D 21/00* (2006.01)

(52) U.S. Cl.
CPC ..... *F25D 21/004* (2013.01); *F25D 21/008* (2013.01)

(58) Field of Classification Search
CPC . F25B 2400/05; F25D 21/004; F25D 21/006; F25D 21/008; F25D 29/00; F25D 2700/00
See application file for complete search history.

(56) References Cited

U.S. PATENT DOCUMENTS 3,945,217 A * 3/1976 Bashark ..... F25D 21/002 338/35
3,965,692 A * 6/1976 Ansted ..... F25B 49/02 62/193
4,061,482 A * 12/1977 Smith ..... F25D 17/065 62/155
4,151,722 A * 5/1979 Willitts ..... F25B 47/022 340/518
4,327,556 A * 5/1982 Zampini ..... F25D 21/006 62/153
4,389,851 A * 6/1983 Chrostowski ..... F25B 13/00 62/155
4,903,498 A * 2/1990 Hanson ..... F25D 29/003 62/126
5,201,185 A * 4/1993 Hanson ..... B60H 1/3207 62/126
5,228,301 A * 7/1993 Sjoholm ..... B60H 1/00007 165/263
5,694,782 A * 12/1997 Alsenz ..... F25B 5/02 62/156
5,743,098 A * 4/1998 Behr ..... A47F 3/0408 62/199
6,058,724 A * 5/2000 Park ..... F25D 21/002 62/153
6,354,097 B1 * 3/2002 Schuster ..... F25B 13/00 62/186
6,715,304 B1 * 4/2004 Wycoff ..... F25D 21/002 62/155
2003/0163999 A1 * 9/2003 Bennett ..... F25D 21/002 62/186
2005/0097918 A1 * 5/2005 Thurman ..... A47F 3/04 62/468
2006/0130494 A1 * 6/2006 Dube ..... F25B 47/022 62/81
2006/0232907 A1 * 10/2006 Huber ..... H02H 9/047 361/160
2009/0000315 A1 * 1/2009 Billman ..... A23G 9/28 62/73
2013/0098076 A1 * 4/2013 Hegedus ..... F25B 5/02 62/81

* cited by examiner

*Primary Examiner* — Jonathan Bradford
*Assistant Examiner* — Kun Kai Ma
(74) *Attorney, Agent, or Firm* — Symbus Law Group; Clifford D. Hyra

(57) ABSTRACT

A refrigerating machine having tube-cooled evaporator & air-cooled evaporator includes a refrigerating device (1) and a defroster (4). The refrigerating device (1) includes a compressor (11), a condenser (12), a reservoir (13), a heat exchanger (14), a first refrigerating electromagnetic valve (15*a*), a first expansion valve (16*a*), a tube-cooled evaporator (2), a second refrigerating electromagnetic valve (15*b*), a second expansion valve (16*b*), an air-cooled evaporator (3), and a plurality of pipes (10*a*, 10*b*, 10*c*, 10*d*, 10*g*). The defroster (4) includes a micro switch (41), a door-opening relay, a high/low pressure switch (43), a compressor electromagnetic switch, a delay relay (45), a set timer (46), a defrosting timer (47), a defrosting conversion contactor, and a defrosting resetting temperature switch (40). The air-cooled evaporator 3 can absorb hot air entering a refrigerating chamber (5) and absorbing moisture in the hot air to increase the freezing effect and refrigerating efficiency in the refrigerating chamber (5).

7 Claims, 9 Drawing Sheets

REFRIGERATING MACHINE HAVING TUBE-COOLED EVAPORATOR AND AIR-COOLED EVAPORATOR

BACKGROUND OF THE INVENTION

The present invention relates to a refrigerating machine and, more particularly, to a refrigerating machine capable of absorbing hot air entering a refrigerating chamber and absorbing moisture in the hot air to increase the refrigerating effect and refrigerating efficiency in the refrigerating chamber.

A typical refrigerating system generally includes a compressor, a condenser, an expansion valve, and an evaporator connected to each other by a piping to form a closed loop in which a coolant circulates. The evaporator is located in a refrigerating chamber. The liquid coolant is delivered by the compressor into the evaporator to absorb the heat in the refrigerating chamber through low-temperature evaporation. Thus, the refrigerating chamber is in a low temperature state to refrigerate food or objects in the refrigerating chamber. Early evaporators are of air-cooled type and include a circulating fan to proceed with forced draught of air, such that heat change can be conducted between the air in the refrigerating chamber and the heat changer tube in the air-cooled evaporator. Since the heat generated due to operation of the motor of the evaporator and friction of the air currents outputted by the circulating fan causes an increase in the temperature in the refrigerating chamber, the refrigerating system must operate continuously to reduce the temperature, leading to considerable consumption of electricity. Furthermore, temperature imbalance exists due to a temperature difference in the order of 4 degrees Celsius between the air inlet and the air outlet.

Recently, air-cooled evaporators have been replaced by tube-cooled evaporators due to the above disadvantages. A tube-cooled evaporator generally includes a tube mounted on an inner top face of a refrigerating chamber and a plurality of radially spaced fins on an outer periphery of the tube. Two faces of each fin and the outer periphery of the tube provide cold energy for heat exchange with the food in the refrigerating chamber. Since the tube with fins is fixed to every area on the inner top face of the refrigerating chamber, the cold air descends naturally to provide a thorough, even refrigeration effect. Thus, no circulating fans are required if the refrigerating chamber is equipped with a tube-cooled evaporator, effectively solving the disadvantages of the air-cooled evaporators.

Since the temperature of the faces of each fin and the outer periphery of the tube is in a range between minus 20 degrees Celsius and minus 50 degrees Celsius for heat exchange with the food in the refrigerating chamber, the hot air enters the refrigerating chamber while the door of the refrigerating chamber is opened, and the moisture in the hot air and the water content in the food frost on the faces of the fins and the outer periphery of the tube due to condensation. The frost accumulates to form an insulating layer adversely affecting the heat exchange efficiency. Thus, timely defrosting the faces of the fins and the outer periphery of the tube is required for maintaining normal operation of the refrigerating system. Current defrosting methods include stopping the compressor, hot gas defrosting, and defrosting by sprinkling water. These methods will result in a wet floor and the risk of injury by the falling frost.

Thus, it is an important issue to absorb the hot air entering the refrigerating chamber, the moisture in the hot air, and the water content in the object to be refrigerated for the purposes of increasing the refrigerating effect and refrigerating efficiency while increasing the defrosting efficiency.

BRIEF SUMMARY OF THE INVENTION

The primary objective of the present invention is to provide a novel refrigerating machine capable of absorbing the hot air entering the refrigerating chamber, the moisture in the hot air, and the water content in the object to be refrigerated for the purposes of increasing the refrigerating effect and refrigerating efficiency while increasing the defrosting efficiency.

The above objective is fulfilled by providing a refrigerating machine including:

a refrigerating device including:

a compressor having an output end and an input end;

a condenser including an input end, an output end and a fan;

a first pipe in communication with and located between the output end of the compressor and the input end of the condenser;

a reservoir including an inlet and an outlet;

a heat exchanger including an input pipe and an output pipe, with the output pipe of the heat exchanger being in communication with the input end of the compressor;

a second pipe;

a first refrigerating electromagnetic valve mounted on the second pipe;

a first expansion valve mounted on the second pipe and located downstream of the first refrigerating electromagnetic valve;

a tube-cooled evaporator in communication with a downstream end of the first expansion valve;

a fifth pipe in communication with a downstream end of the tube-cooled evaporator, with the input pipe of the heat exchanger being in communication with the fifth pipe;

a third pipe in communication with the second pipe and located upstream of the first refrigerating electromagnetic valve;

a second refrigerating electromagnetic valve mounted on the third pipe;

a second expansion valve mounted on the third pipe and located downstream of the second refrigerating electromagnetic valve;

an eighth pipe in communication with a downstream end of the second expansion valve;

an air-cooled evaporator in communication with a downstream end of the eighth pipe;

a fourth pipe in communication with a downstream end of the air-cooled evaporator and the fifth pipe; and an in-chamber temperature switch having a first contact and a second contact, wherein the inlet of the reservoir is in communication with the output end of the condenser, the outlet of the reservoir is in communication with the second pipe; and a defroster including:

a micro switch having a first contact and a second contact;

a door-opening relay including a coil, a first contact, a second contact, a third contact, and a fourth contact;

a high/low pressure switch;

a compressor electromagnetic switch including an overload protector and a coil electrically connected to the overload protector;

a delay relay having a contact;

a set timer having a first contact and a second contact;

a defrosting timer having a first contact and a second contact;

a defrosting conversion contactor including a coil, a first contact, a second contact, a third contact, and a fourth contact;

a seventh pipe;

a defrosting electromagnetic valve mounted on the seventh pipe;

a defrosting resetting temperature switch having a fixed contact, a first contact, and a second contact, wherein the micro switch is mounted in an entrance of a refrigerating chamber, the first contact of the micro switch is electrically connected to the coil of the door-opening relay, the first contact of the door-opening relay, the contact of the delay relay, and the second contact of the door-opening relay, wherein the second contact of the micro switch is electrically connected to the delay relay and the contact of the delay relay, wherein the contact of the delay relay is electrically connected to the first contact of the door-opening relay, wherein the second contact of the door-opening relay is electrically connected to the second refrigerating electromagnetic valve, the fan of the condenser, the third contact of the door-opening relay, the first contact of the set timer, the defrosting timer, the defrosting electromagnetic valve, and the coil of the defrosting conversion contactor, wherein the third contact of the door-opening relay is electrically connected to the first contact of the set timer, the second contact of the set timer, a plurality of fans of the air-cooled evaporator, the high/low pressure switch, and the in-chamber temperature switch, wherein the second contact of the set timer is electrically connected to the fourth contact of the door-opening relay, and the fourth contact of the door-opening relay is electrically connected to the first refrigerating electromagnetic valve, wherein the high/low pressure switch is electrically connected to the in-chamber temperature switch, the third contact of the door-opening relay, the coil of the compressor electromagnetic switch, and the overload protector, wherein the first contact of the defrosting timer is electrically connected to the first contact of the defrosting resetting temperature switch, the first contact of the defrosting conversion contactor, and the third contact of the defrosting conversion contactor, wherein the second contact of the defrosting timer is electrically connected to the fourth contact of the defrosting conversion contactor, wherein the first contact of the defrosting conversion contactor is electrically connected to the fixed contact of the defrosting resetting temperature switch, the first contact of the defrosting resetting temperature switch, and the third contact of the defrosting resetting temperature switch, wherein the second contact of the defrosting conversion contactor is electrically connected to the second refrigerating magnetic valve, the fan of the condenser, the plurality of fans of the air-cooled evaporator, and the fourth contact of the defrosting conversion contactor, wherein the third contact of the defrosting conversion contactor is electrically connected to the defrosting magnetic valve, wherein the coil of the defrosting conversion contactor is electrically connected to the fixed contact of the defrosting resetting temperature switch and the first contact of the defrosting conversion contactor, wherein the seventh pipe including a first end located between the compressor and the condenser and a second end in communication with the eighth pipe connected between the second expansion valve and the air-cooled evaporator.

Preferably, a manual selection switch is mounted between the coil of the compressor electromagnetic switch and the micro switch, the coil of the door-opening relay, the high/low pressure switch, the delay relay, the set timer, the defrosting timer, the defrosting conversion contactor, the defrosting electromagnetic valve, and the in-chamber temperature switch.

Preferably, the heat exchanger includes a closed container having an outer barrel and an inner barrel fixed inside the outer barrel. The outer barrel includes an inlet tube in communication with the outlet end of the reservoir. The outer barrel further includes an outlet tube in communication with the first and second expansion valves. The inner barrel includes the input pipe in communication with the fifth pipe. The inner barrel further includes the output pipe in communication with the input end of the compressor.

Preferably, the tube-cooled evaporator includes a tube, a plurality of radially spaced fins integrally formed on an outer periphery of the tube, and a bracket. The tube or the plurality of radially spaced fins is fixed by the bracket to an inner top face of the refrigerating chamber.

Preferably, the air-cooled evaporator includes a tank fixed to the inner top face of the refrigerating chamber, the plurality of fans fixed to the tank, a row of copper pipes mounted in the tank, and a water pan mounted to a bottom of the tank. A water draining pipe is mounted to the water pan.

Preferably, the tube-cooled evaporator further includes:

a sixth pipe in communication with and located between the first refrigerating electromagnetic valve on the second pipe and the first expansion valve;

a third expansion valve mounted on a downstream end of the sixth pipe; and a first tube-cooled evaporator in communication with a downstream end of the third expansion valve, with the first tube-cooled evaporator including a tube, a plurality of radially spaced fins integrally formed on an outer periphery of the tube, and a bracket, with the tube or the plurality of radially spaced fins fixed by the bracket to an inner top face of the refrigerating chamber, with the tube of the first tube-cooled evaporator including an end in communication with the downstream end of the third expansion valve, with the tube of the first tube-cooled evaporator including another end in communication with the fifth pipe.

The present invention will become clearer in light of the following detailed description of illustrative embodiments of this invention described in connection with the drawings.

DETAILED DESCRIPTION OF THE INVENTION

Figure 1:
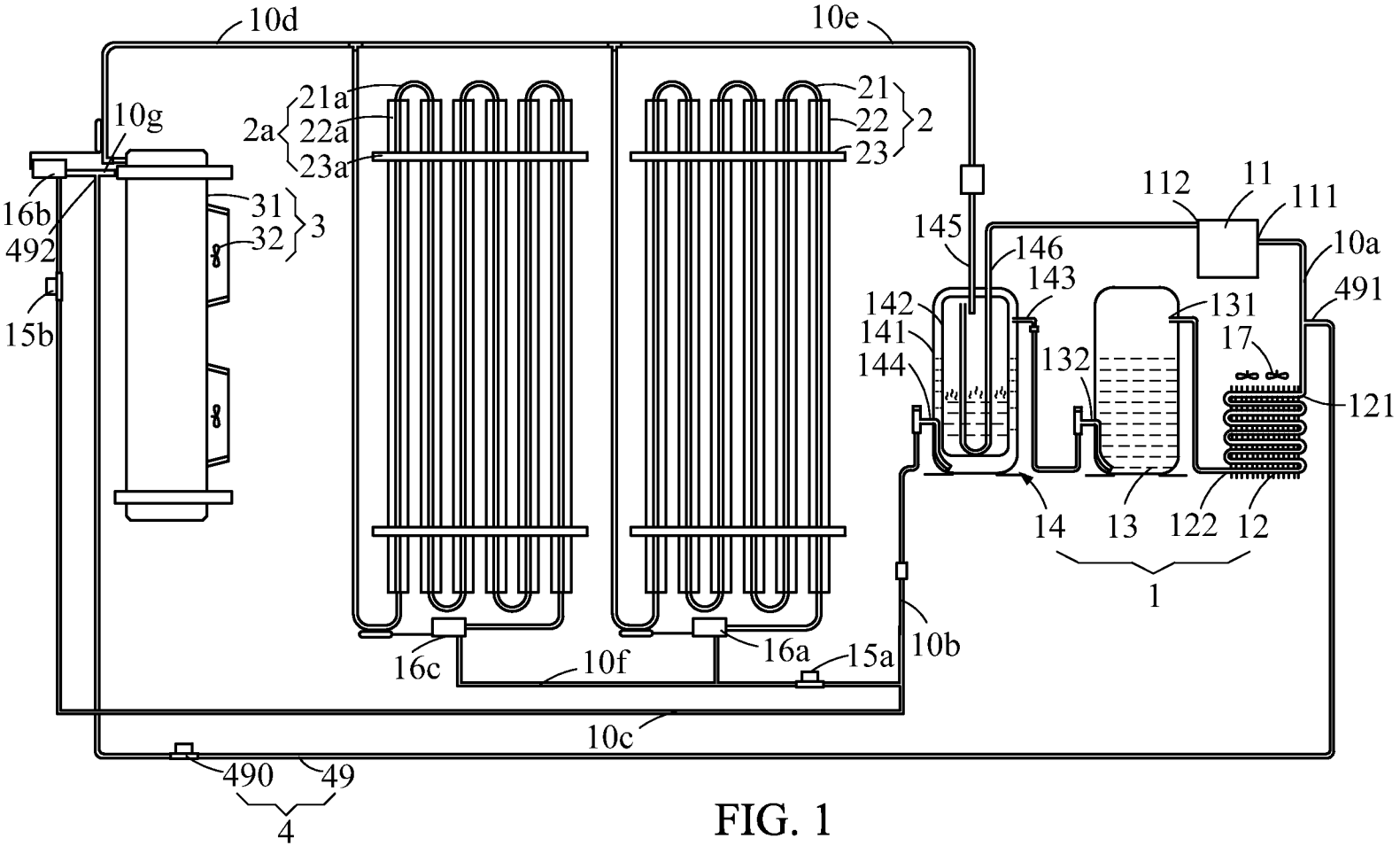
FIG. 1 is a diagrammatic view of a refrigerating machine according to the present invention.
Figure 2:
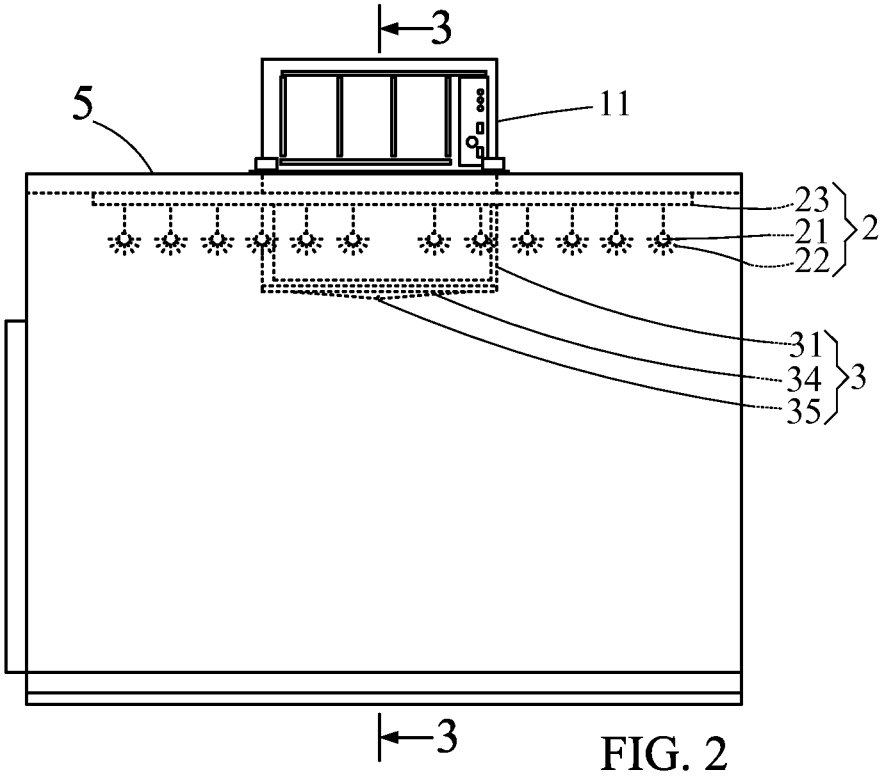
FIG. 2 is a side view of a refrigerating chamber of the refrigerating machine of FIG. 1.
Figure 3:
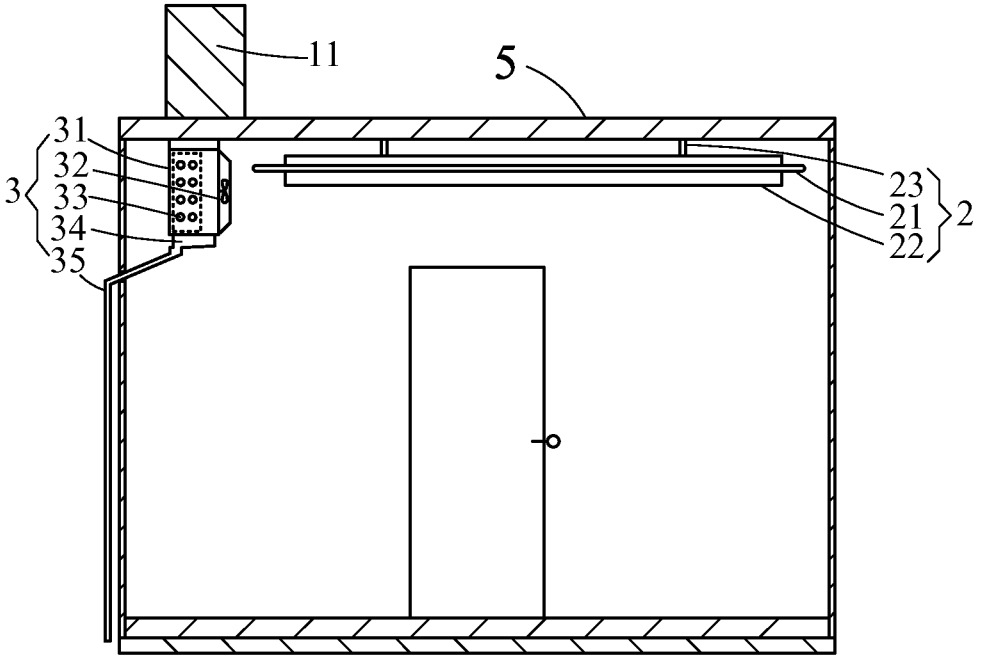
FIG. 3 is a cross sectional view taken along section line 3-3 of FIG. 2.

With reference to FIGS. 1-3 and 10, a refrigerating machine according to the present invention includes a refrigerating device 1 and a defroster 4. The refrigerating device 1 includes a compressor 11 having an output end 111 and an input end 112. A condenser 12 includes an input end 121, an output end 122 and a fan 17. A first pipe 10*a* is in communication with and located between the output end 111 of the compressor 11 and the input end 121 of the condenser 12. A reservoir 13 includes an inlet 131 and an outlet 132. The refrigerating device 1 further includes a heat exchanger 14 for providing a liquid coolant in a low-temperature and condensed state to first, second, and third expansion valves 16*a*, 16*b*, 16*c* and for providing an overheated gaseous coolant to the compressor 11.

A first refrigerating electromagnetic valve 15*a* is mounted on an appropriate location on a second pipe 10*b*. The first refrigerating electromagnetic valve 15*a* can block or not block the flow of the coolant in the second pipe 10*b* to a tube-cooled evaporator 2. The first expansion valve 16*a* is mounted on the second pipe 10*b* and located downstream of the first refrigerating electromagnetic valve 15*a*. The liquid coolant expands while flowing through the first expansion valve 16*a*. The tube-cooled evaporator 2 is in communication with a downstream end of the first expansion valve 16*a*. A fifth pipe 10*e* is in communication with a downstream end of the tube-cooled evaporator 2.

A third pipe 10*c* is in communication with the second pipe 10*b* and located upstream of the first refrigerating electromagnetic valve 15*a*. A second refrigerating electromagnetic valve 15*b* is mounted on an appropriate location on the third pipe 10*c* for controlling blocking or not blocking of the flow of the coolant in the second pipe 10*b* to an air-cooled evaporator 3. A second expansion valve 16*b* is mounted on the third pipe 10*c* and located downstream of the second refrigerating electromagnetic valve 15*b*. The liquid coolant expands while flowing through the second expansion valve 16*b*.

An eighth pipe 10*g* is in communication with a downstream end of the second expansion valve 16*b*. The air-cooled evaporator 3 is in communication with a downstream end of the eighth pipe 10*g*. A fourth pipe 10*d* is in communication with a downstream end of the air-cooled evaporator 3 and the fifth pipe 10*e*. An in-chamber temperature switch 18 has a first contact 181 and a second contact 182. The inlet 131 of the reservoir 13 is in communication with the output end 122 of the condenser 12. The outlet 132 of the reservoir 13 is in communication with the second pipe 10*b*.

In the form shown, the heat exchanger 14 includes a closed container having an outer barrel 141 and an inner barrel 142 fixed inside the outer barrel 141. The outer barrel 141 receives the low-temperature liquid coolant from the reservoir 13. The inner barrel 142 receives the high-temperature gaseous coolant from the fifth pipe 10*e*. Thus, the liquid coolant is separate from the gaseous coolant. An inlet tube 143 is mounted to an upper end of the outer barrel 141 and is in communication with the outlet 132 of the reservoir 13. An outlet tube 144 is mounted to a lower end of the outer barrel 141 and is in communication with the first, second, and third expansion valves 16*a*, 16*b*, and 16*c*, such that the liquid coolant in the outer barrel 141 can enter the first, second, and third expansion valves 16*a*, 16*b*, and 16*c*. An input pipe 145 is mounted to an upper end of the inner barrel 142 and in communication with the fifth pipe 10*e*. Furthermore, an output pipe 146 is mounted to the upper end of the inner barrel 142 and in communication with the input end 112 of the compressor 11. Thus, the low-temperature gaseous coolant from the tube-cooled evaporator 2 and the air-cooled evaporator 3 can flow through the fifth pipe 10*e* and the input pipe 145 into the inner barrel 142 and then flow into the compressor 11 via the output pipe 146 and the input end 112 of the compressor 11. As a result, the coolant in the outer barrel 141 and the inner barrel 142 can proceed with heat exchange in the heat exchanger 14 to save energy.

The tube-cooled evaporator 2 includes a tube 21 through which the liquid coolant flows, a plurality of radially spaced fins 22 integrally formed on an outer periphery of the tube 21, and a bracket 23. The tube 21 or the plurality of radially spaced fins 22 is fixed by the bracket 23 to an inner top face of a refrigerating chamber 5. An end of the tube 21 is in communication with the downstream end of the first expansion valve 16*a*. The other end of the tube 21 is in communication with the fifth pipe 10*e*. When the expanded liquid coolant flows through the tube 21, the outer periphery of the tube 21 and two faces of each fin 22 can provide cold energy for heat exchange with the food in the refrigerating chamber 5.

The air-cooled evaporator 3 can be of a conventional type. In the form shown, the air-cooled evaporator 3 includes a tank 31 fixed to the inner top face of the refrigerating chamber 5, a plurality of fans 32 fixed to the tank 31, a row of copper pipes 33 mounted in the tank 31, and a water pan 34 mounted to a bottom of the tank 31. A water draining pipe 35 is mounted to the water pan 34. The row of copper pipes 33 is located behind the fans 32, and a coolant pipe is transversely wound through the row of copper pipes 33. The compressed coolant from the compressor 11 is guided into the coolant pipe from top. Water can be collected by the water pan 34 at the bottom of the tank 31 and drained by the water draining pipe 35.

Figure 10:
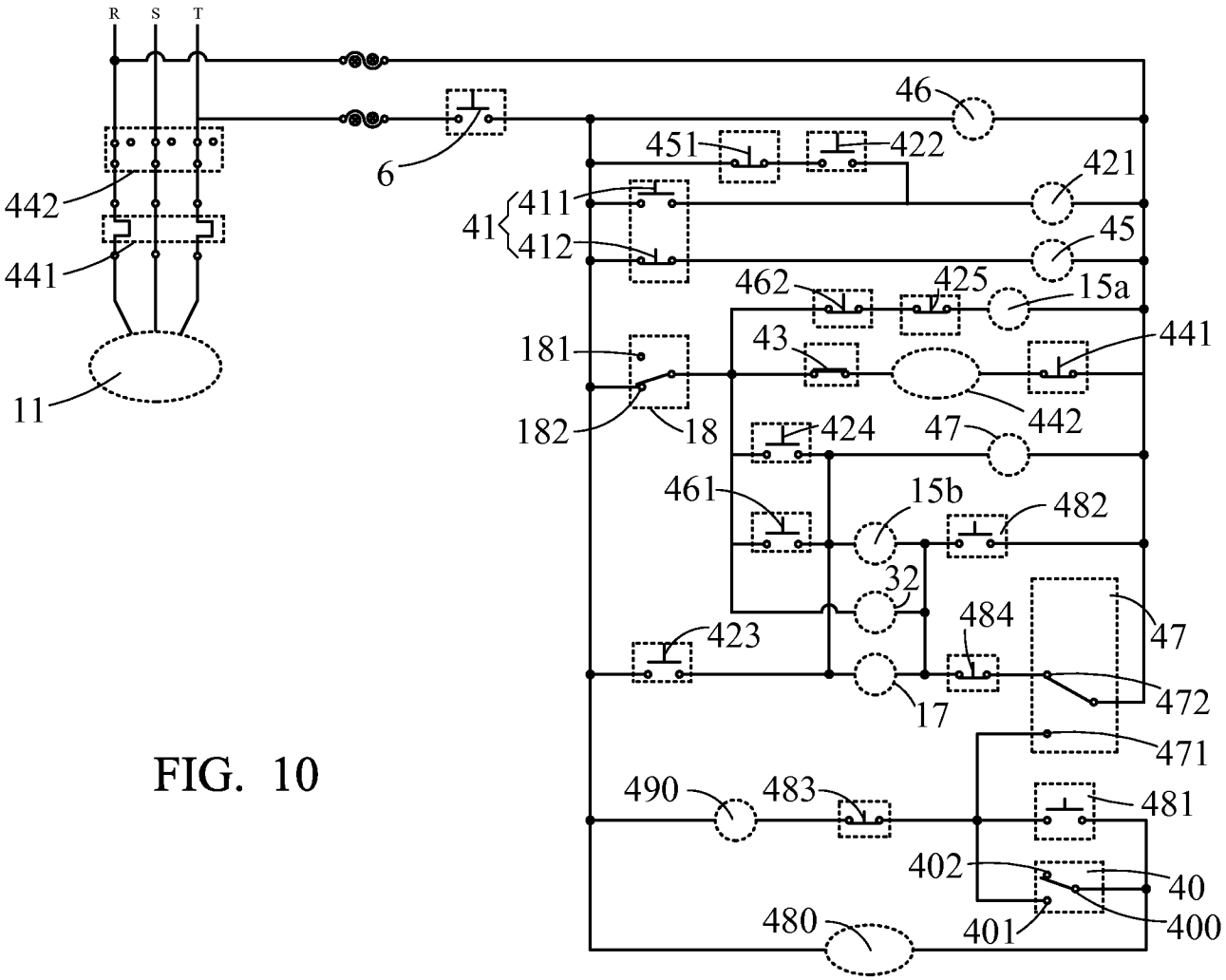
FIG. 10 is a view of the circuitry of the refrigerating machine according to the present invention, wherein the refrigerating machine is not proceeding with refrigerating operation.

With reference to FIGS. 1 and 10, the tube-cooled evaporator 2 further includes a sixth pipe 10*f* in communication with and located between the first refrigerating electromagnetic valve 15*a* on the second pipe 10*b* and the first expansion valve 16*b*. The third expansion valve 16*c* is mounted on a downstream end of the sixth pipe 10*f*. A first tube-cooled evaporator 2*a* is in communication with a downstream end of the third expansion valve 16*c*. The first tube-cooled evaporator 2*a* includes a tube 21*a*, a plurality of radially spaced fins 22*a* integrally formed on an outer periphery of the tube 21*a*, and a bracket 23*a*. The tube 21*a* or the plurality of radially spaced fins 22*a* is fixed by the bracket 23*a* to the inner top face of the refrigerating chamber 5. An end of the tube 21*a* of the first tube-cooled evaporator 2*a* is in communication with the downstream end of the third expansion valve 16*c*. The other end of the tube 21*a* of the first tube-cooled evaporator 2*a* is in communication with the fifth pipe 10*e*.

The defroster 4 includes a micro switch 41 having a first contact 411 and a second contact 412. A door-opening relay includes a coil 421, a first contact 422, a second contact 423, a third contact 424, and a fourth contact 425. The defroster 4 further includes a high/low pressure switch 43. A compressor electromagnetic switch includes an overload protector 441 and a coil 442 electrically connected to the overload protector 441. The defroster 4 further includes a delay relay 45 having a contact 451. A set timer 46 has a first contact 461 and a second contact 462. A defrosting timer 47 has a first contact 471 and a second contact 472. A defrosting conversion contactor includes a coil 480, a first contact 481, a second contact 482, a third contact 483, and a fourth contact 484. The defroster 4 further includes a seventh pipe 49. A defrosting electromagnetic valve 490 is mounted on the seventh pipe 49 for blocking or not blocking the flow of the high pressure/high temperature gaseous coolant in the seventh pipe 49. A defrosting resetting temperature switch 40 has a fixed contact 400, a first contact 401, and a second contact 402.

The micro switch 41 is mounted in an entrance of the refrigerating chamber 5. The circuit of the first contact 411 of the micro switch 41 becomes conductive when a door of the refrigerating chamber 5 is opened. On the other hand, the circuit of the second contact 412 of the micro switch 41 becomes conductive when the door of the refrigerating chamber 5 is closed. The first contact 411 of the micro switch 41 is electrically connected to the coil 421 of the door-opening relay, the first contact 422 of the door-opening relay, the contact 451 of the delay relay 45, and the second contact 423 of the door-opening relay. The second contact 412 of the micro switch 41 is electrically connected to the delay relay 45 and the contact 451 of the delay relay 45.

The contact 451 of the delay relay 45 is electrically connected to the first contact 422 of the door-opening relay. The second contact 423 of the door-opening relay is electrically connected to the second refrigerating electromagnetic valve 15*b*, the fan 17 of the condenser 12, the third contact 424 of the door-opening relay, the first contact 461 of the set timer 46, the defrosting timer 47, the defrosting electromagnetic valve 490, and the coil 480 of the defrosting conversion contactor. The second refrigerating electromagnetic valve 15*b* can be activated to open or close the third pipe 10*c* by controlling conducting or non-conducting of the first contact 461 of the set timer 46.

The third contact 424 of the door-opening relay is electrically connected to the first contact 461 of the set timer 46, the second contact 462 of the set timer 46, the fans 32 of the air-cooled evaporator 3, the high/low pressure switch 43, and the in-chamber temperature switch 18. The second contact 462 of the set timer 46 is electrically connected to the fourth contact 425 of the door-opening relay. The fourth contact 425 of the door-opening relay is electrically connected to the first refrigerating electromagnetic valve 15*a*. The first refrigerating electromagnetic valve 15*a* can be activated to open or close the second pipe 10*b* by controlling conducting or non-conducting of the second contact 462 of the set timer 46.

The high/low pressure switch 43 is electrically connected to the in-chamber temperature switch 18, the third contact 424 of the door-opening relay, the coil 442 of the compressor electromagnetic switch, and the overload protector 441. The first contact 471 of the defrosting timer 47 is electrically connected to the first contact 401 of the defrosting resetting temperature switch 40, the first contact 481 of the defrosting conversion contactor, and the third contact 483 of the defrosting conversion contactor. The second contact 472 of the defrosting timer 47 is electrically connected to the fourth contact 484 of the defrosting conversion contactor.

The first contact 481 of the defrosting conversion contactor is electrically connected to the fixed contact 400 of the defrosting resetting temperature switch 40, the first contact 401 of the defrosting resetting temperature switch 40, and the third contact 483 of the defrosting resetting temperature switch 40. The second contact 482 of the defrosting conversion contactor is electrically connected to the second refrigerating magnetic valve 15*b*, the fan 17 of the condenser 12, the fans 32 of the air-cooled evaporator 3, and the fourth contact 484 of the defrosting conversion contactor. The third contact 483 of the defrosting conversion contactor is electrically connected to the defrosting magnetic valve 490. The coil 480 of the defrosting conversion contactor is electrically connected to the fixed contact 400 of the defrosting resetting temperature switch 40 and the first contact 481 of the defrosting conversion contactor.

A first end of the seventh pipe 49 is located between the compressor 11 and the condenser 12. A second end 492 of the seventh pipe 49 is in communication with the eighth pipe 10*g* connected between the second expansion valve 16*b* and the air-cooled evaporator 3. The defrosting magnetic valve 490 can be activated to open or close the seventh pipe 49 by controlling conducting or non-conducting of the first contact 471 of the defrosting timer 47.

With reference to FIG. 10, a manual selection switch 6 is mounted between the coil 442 of the compressor electromagnetic switch and the micro switch 41, the coil 421 of the door-opening relay, the high/low pressure switch 43, the delay relay 45, the set timer 46, the defrosting timer 47, the defrosting conversion contactor, the defrosting electromagnetic valve 490, and the in-chamber temperature switch 18. The manual selection switch 6 allows manual operation of the refrigerating machine according to the present invention.

Figure 4:
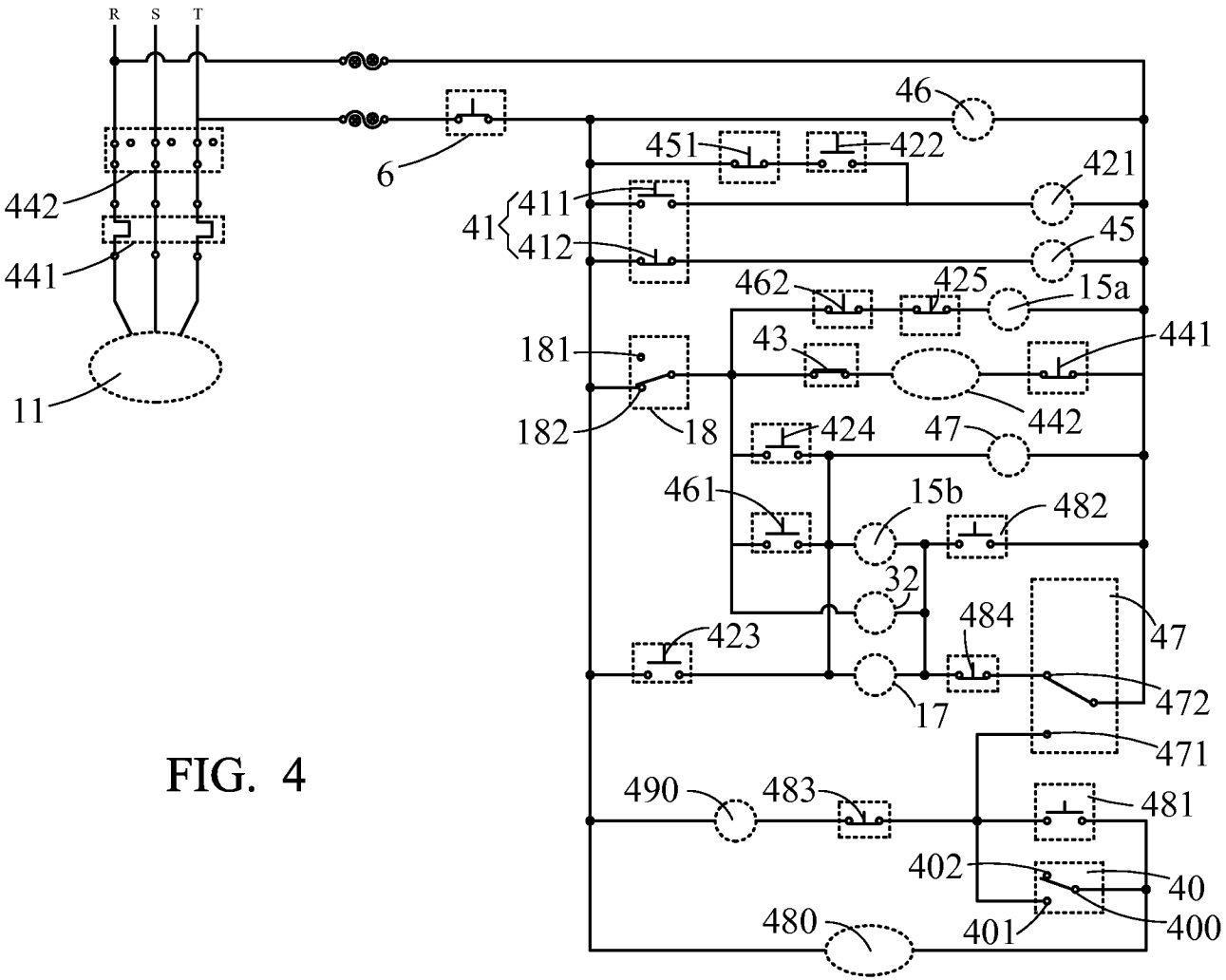
FIG. 4 is a view of a circuitry of the refrigerating machine according to the present invention, wherein a tube-cooled evaporator of the refrigerating machine according to the present invention is working during refrigerating operation.

With reference to FIGS. 1 and 4, when the manual selection switch 6 is pressed while the tube-cooled evaporator 2 operates to proceed with refrigerating operation, the second contact 182 of the in-chamber temperature switch 18 and the second contact 462 of the set timer 46 become conductive. The first refrigerating magnetic valve 15*a* opens the second pipe 10*b* and the third expansion valve 16*c*, because the second contact 462 of the set timer 46 is conductive. At the same time, since the second contact 182 of the in-chamber temperature switch 18 becomes conductive, the high/low pressure switch 43 and the overload protector 441 are activated, and the coil 442 of the compressor electromagnetic switch is energized to activate the compressor 11 to produce cold. The coolant is compressed by the compressor 11 into high temperature/high pressure gaseous coolant and flows through the first pipe 10*a* into the condenser 12 at which the gaseous coolant turns into high pressure/normal temperature liquid coolant after a temperature drop. Then, the liquid coolant flows through the reservoir 13, the inlet tube 143 and the outlet tube 144 of the heat exchanger 14, the second pipe 10*b*, the first refrigerating electromagnetic valve 15*a* into the first and third expansion valves 16*a* and 16*c*. The coolant turns into low temperature/low pressure liquid coolant after expansion and then flows through the tube-cooled evaporator 2 and the first tube-cooled evaporator 2*a*. The tube-cooled evaporator 2 and the first tube-cooled evaporator 2*a* provide cold energy for heat exchange with the food in the refrigerating chamber 5. Then, the coolant flows through the fifth pipe 10*e*, the input pipe 145 and the output pipe 146 of the inner barrel 142 of the heat exchanger 14, and flows back into the compressor 11, completing a cold-producing cycle of the tube-cooled evaporator 2.

Figure 5:
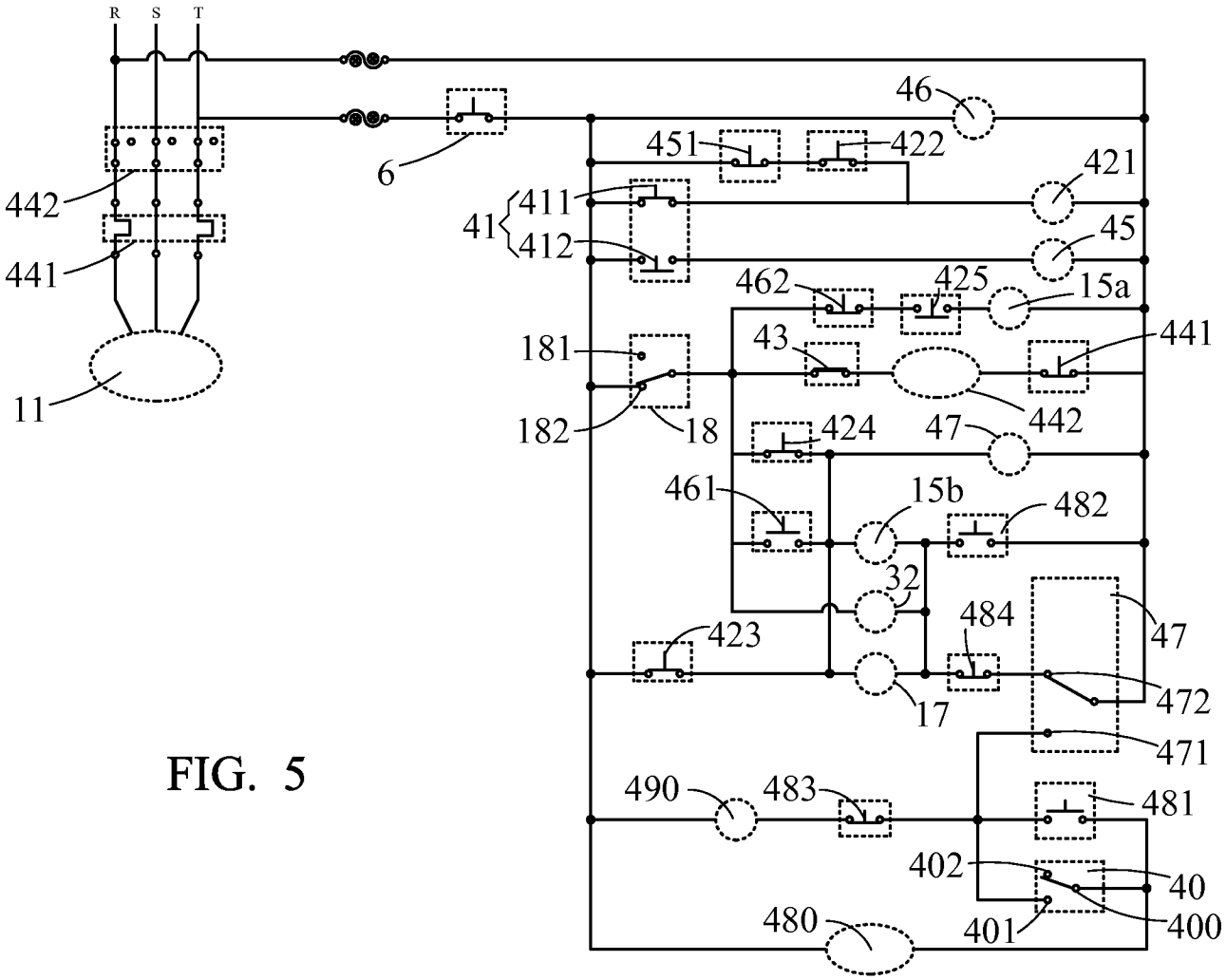
FIG. 5 is a view of the circuitry of the refrigerating machine according to the present invention, wherein an air-cooled evaporator of the refrigerating machine is working while a door of a refrigerating chamber is opened.

With reference to FIGS. 1 and 5, when the door of the refrigerating chamber 5 is opened, the first contact 411 of the micro switch 41 becomes conductive, and the second contact 412 of the micro switch 41 becomes non-conductive. At the same time, the coil 421 of the door-opening relay is energized, such that the first contact 422, the second contact 423, and the third contact 424 of the door-opening relay become conductive, and the fourth contact 425 becomes non-conductive and, thus, closes the first refrigerating electromagnetic valve 15*a*. Since the first, second and third contacts 422, 423, and 424 become conductive, the third pipe 10*c* is opened, and the fan 17 of the condenser 12 and the fans 32 of the air-cooled evaporator 3 are activated. Since the second contact 182 of the in-chamber temperature switch 18 becomes conductive, the high/low pressure switch 43 and the overload protector 441 are activated, and the coil 442 of the compressor electromagnetic switch is energized to activate the compressor 11 to produce cold. The coolant is compressed by the compressor 11 into high temperature/high pressure gaseous coolant and flows through the first pipe 10*a* into the condenser 12 at which the gaseous coolant turns into high pressure/normal temperature liquid coolant after a temperature drop. Then, the liquid coolant flows through the reservoir 13, the inlet tube 143 and the outlet tube 144 of the heat exchanger 14, the second pipe 10*b*, and the third pipe 10*c* into the second expansion valves 16*b*. The coolant turns into low temperature/low pressure liquid coolant after expansion due to flowing through the expansion valve 16*b*. Then, the coolant flows through the eighth pipe 10*g* and the air-cooled evaporator 3. The air-cooled evaporator 3 provides cold energy for heat exchange. Then, the coolant flows through the fourth pipe 10*d*, the fifth pipe 10*e*, the input pipe 145 and the output pipe 146 of the inner barrel 142 of the heat exchanger 14, and flows back into the compressor 11, completing a cold-producing cycle of the air-cooled evaporator 3.

Figure 6:
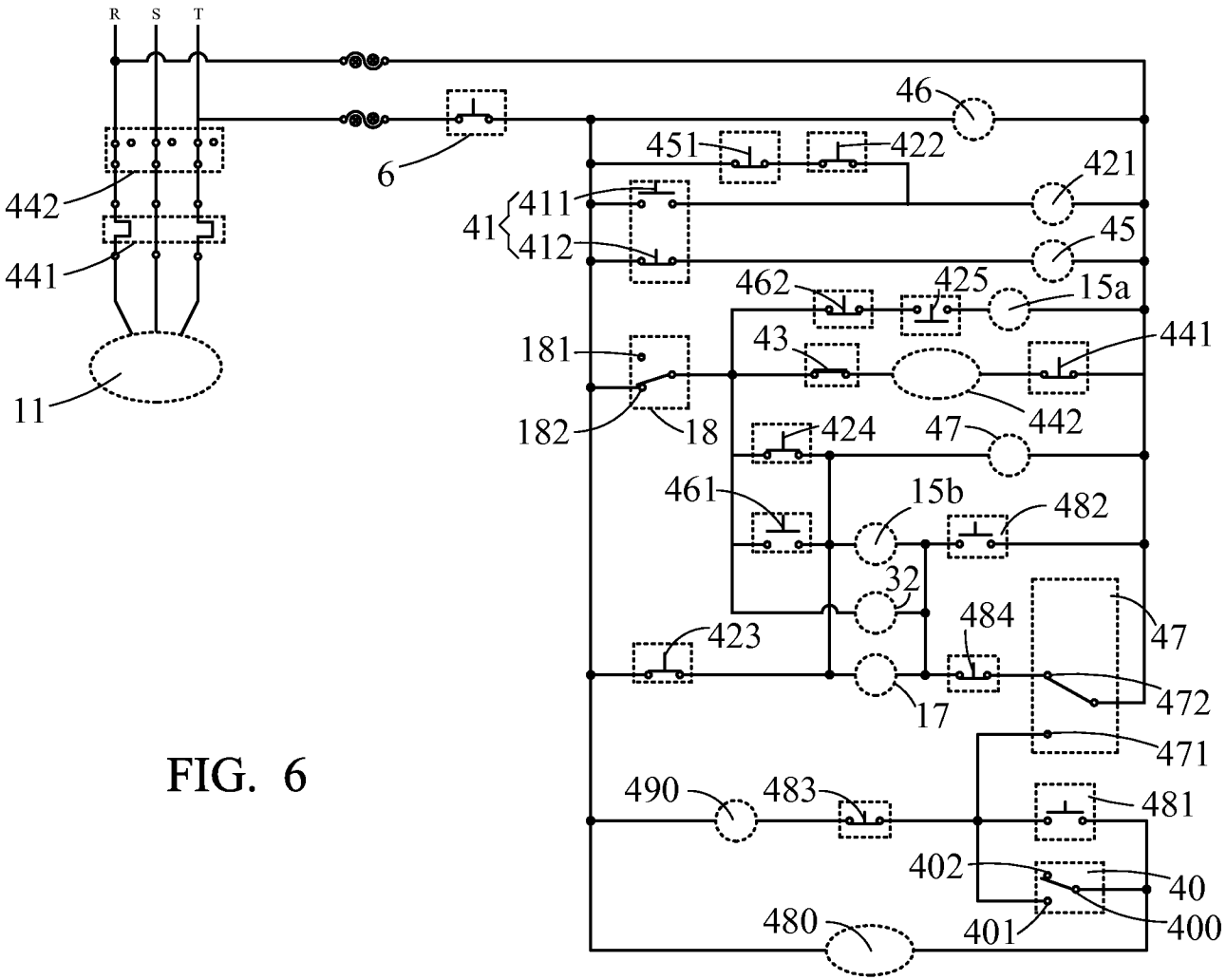
FIG. 6 is a view of the circuitry of the refrigerating machine according to the present invention, wherein the air-cooled evaporator of the refrigerating machine is working while a door of a refrigerating chamber is closed.

With reference to FIGS. 1 and 6, when the door of the refrigerating chamber 5 is closed, the first contact 411 of the micro switch 41 becomes non-conductive, and the second contact 412 of the micro switch 41 becomes conductive such that the delay relay 45 is activated to start a countdown function. If it is set that the contact 451 of the delay relay 45 turns into non-conductive after the door has been closed for five minutes, the contact 451 of the delay relay 45 will automatically interrupt the cold-producing procedure of the air-cooled evaporator 3 after five minutes and start the cold-producing procedure of the tube-cooled evaporator 2. Before the contact 451 of the delay relay 45 turns into non-conductive, since the coil 421 of the door-opening relay is still provided with electricity during these five minutes, the first, second, and third contacts 422, 423, and 424 of the door-opening relay are still conductive while the fourth contact 425 is still non-conductive. Because the first, second, and third contacts 422, 423, and 424 are still conductive, the fan 17 of the condenser 12 and the fans 32 of the air-cooled evaporator 3 are activated, and the second refrigerating electromagnetic valve 15*b* opens the third pipe 10*c*. Because the fourth contact 425 is still non-conductive, the first refrigerating electromagnetic valve 15*a* is non-conductive and, thus, closed. Since the second contact 182 is conductive, the high/low pressure switch 43 and the overload protector 441 are activated, and the coil 442 of the compressor electromagnetic switch is energized to activate the compressor 11 to produce cold. The coolant is compressed by the compressor 11 into high temperature/high pressure gaseous coolant and flows through the first pipe 10*a* into the condenser 12 at which the gaseous coolant turns into high pressure/normal temperature liquid coolant after a temperature drop. Then, the liquid coolant flows through the reservoir 13, the inlet tube 143 and the outlet tube 144 of the heat exchanger 14, the second pipe 10*b*, and the third pipe 10*c* into the second expansion valves 16*b*. The coolant turns into low temperature/low pressure liquid coolant after expansion due to flowing through the expansion valve 16*b*. Then, the coolant flows through the eighth pipe 10*g* and the air-cooled evaporator 3. The air-cooled evaporator 3 provides cold energy for heat exchange. Then, the coolant flows through the fourth pipe 10*d*, the fifth pipe 10*e*, the input pipe 145 and the output pipe 146 of the inner barrel 142 of the heat exchanger 14, and flows back into the compressor 11, completing a cold-producing cycle of the air-cooled evaporator 3. Since the air-cooled evaporator 3 still provides cold energy for heat exchange for five minutes after the door has been closed, the hot air entering the refrigerating chamber 5, the moisture in the hot air, and the water content in the object to be refrigerated will be absorbed by the air-cooled evaporator 3 and freeze into frost. Since the tube-cooled evaporator 2 does not provide cold energy for heat exchange, the tube-cooled evaporator 2 will not frost.

Figure 7:
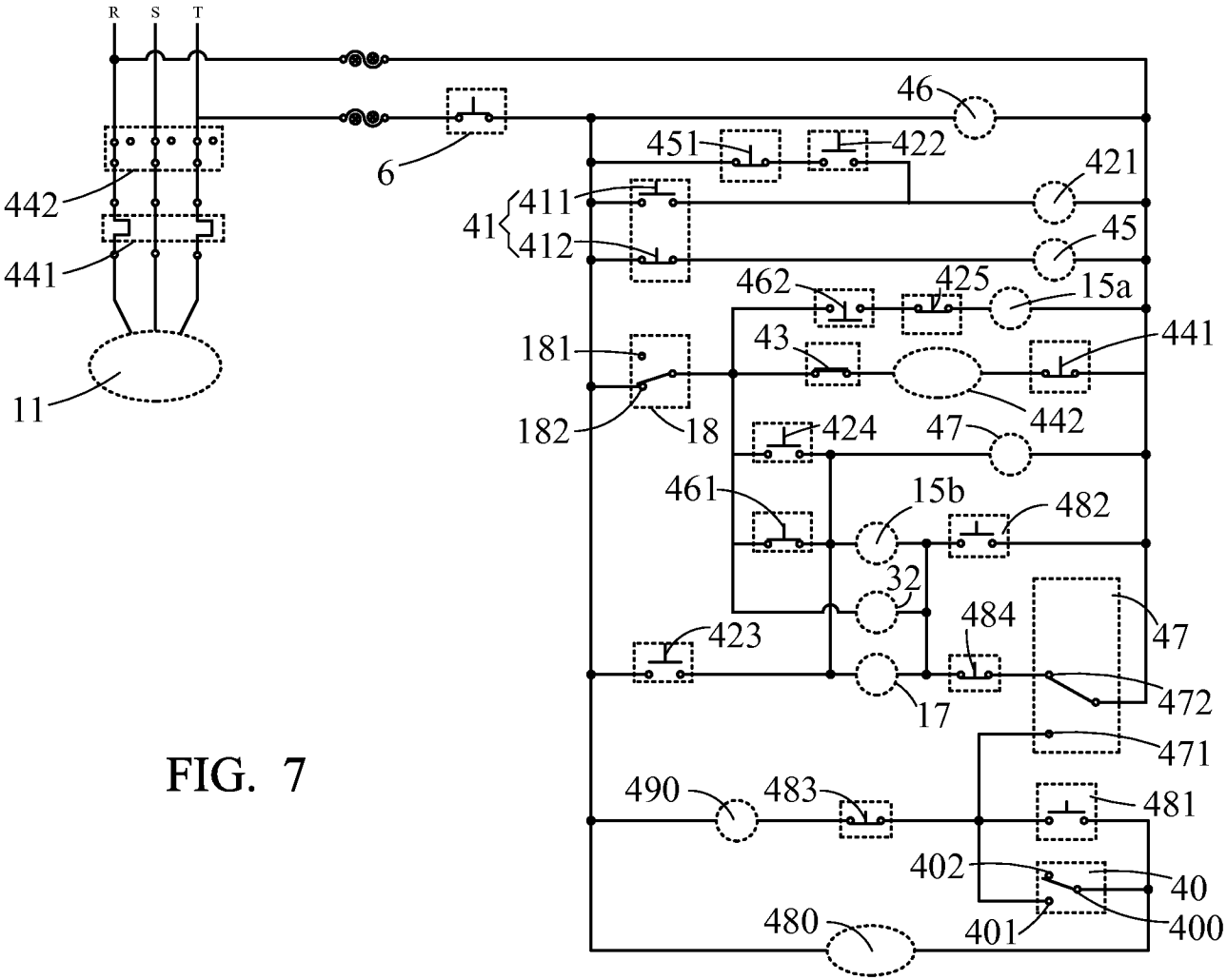
FIG. 7 is a view of the circuitry of the refrigerating machine according to the present invention, wherein the air-cooled evaporator is working during refrigerating operation.

With reference to FIGS. 1 and 7, when the object to be refrigerated is not vacuum packaged and releases water, the tube-cooled evaporator 2 and the air-cooled evaporator 3 can be alternately used. As an example, the tube-cooled evaporator 2 can be stopped after operating for 5 hours. The set timer 46 automatically starts the air-cooled evaporator 3 to operate for 1 hour and then stop the air-cooled evaporator 3. In a case that the tube-cooled evaporator 2 has been operated for 5 hours, the first contact 461 of the set timer 46 becomes conductive to activate the fan 17 of the condenser 12 and the fans 32 of the air-cooled evaporator 3, and the second refrigerating electromagnetic valve 15*b* opens the third pipe 10*c*. At the same time, the second contact 462 becomes non-conductive, and the first refrigerating electromagnetic valve 15*a* is closed. Since the second contact 182 of the in-chamber temperature switch 18 is conductive, the high/low pressure switch 43 and the overload protector 441 are activated, and the coil 442 of the compressor electromagnetic switch is energized to activate the compressor 11 to produce cold. The coolant is compressed by the compressor 11 into high temperature/high pressure gaseous coolant and flows through the first pipe 10*a* into the condenser 12 at which the gaseous coolant turns into high pressure/normal temperature liquid coolant after a temperature drop. Then, the liquid coolant flows through the reservoir 13, the inlet tube 143 and the outlet tube 144 of the heat exchanger 14, the second pipe 10*b*, and the third pipe 10*c* into the second expansion valves 16*b*. The coolant turns into low temperature/low pressure liquid coolant after expansion due to flowing through the expansion valve 16*b*. Then, the coolant flows through the eighth pipe 10*g* and the air-cooled evaporator 3. The air-cooled evaporator 3 provides cold energy for heat exchange with the food in the refrigerating chamber 5. Then, the coolant flows through the fourth pipe 10*d*, the fifth pipe 10*e*, the input pipe 145 and the output pipe 146 of the inner barrel 142 of the heat exchanger 14, and flows back into the compressor 11, completing a cold-producing cycle of the air-cooled evaporator 3. Since the air-cooled evaporator 3 still provides cold energy for heat exchange, the hot air entering the refrigerating chamber 5, the moisture in the hot air, and the water content in the object to be refrigerated will be absorbed by the air-cooled evaporator 3 and freeze into frost. Since the tube-cooled evaporator 2 does not provide cold energy for heat exchange, the tube-cooled evaporator 2 will not frost.

Figure 8:
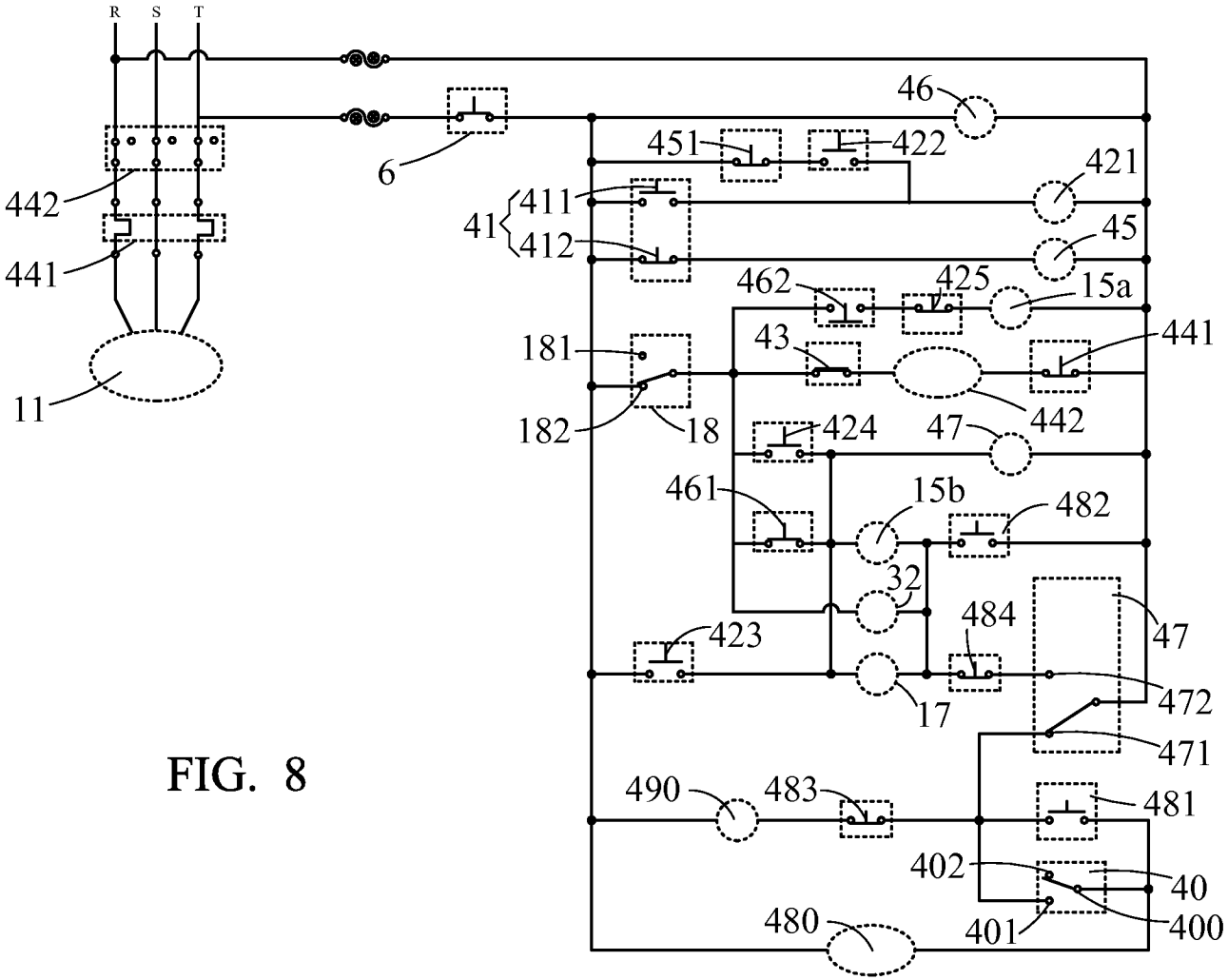
FIG. 8 is a view of the circuitry of the refrigerating machine according to the present invention during defrosting.

With reference to FIGS. 1 and 8, after the air-cooled evaporator 3 has been operated for a period of time set by the defrosting timer 47, the defrosting operation is activated. The first contact 471 of the defrosting timer 47 becomes conductive, and the second contact 472 of the defrosting timer 47 becomes non-conductive. Power is supplied to the conductive third contact 483 of the defrosting conversion contactor to activate the defrosting electromagnetic valve 490 and, thus, opens the seventh pipe 49. The high pressure/high temperature gaseous coolant flows through the first pipe 10*a*, the first end 491 of the seventh pipe 49, the second end 492 of the seventh pipe 49, the eighth pipe 10*g*, and the air-cooled evaporator 3 to proceed with the defrosting operation. The frost on the surface of the air-cooled evaporator 3 is heated and melts, and the water resulting from defrosting is collected in the water pan 34 and then drained via the water draining pipe 35.

Figure 9:
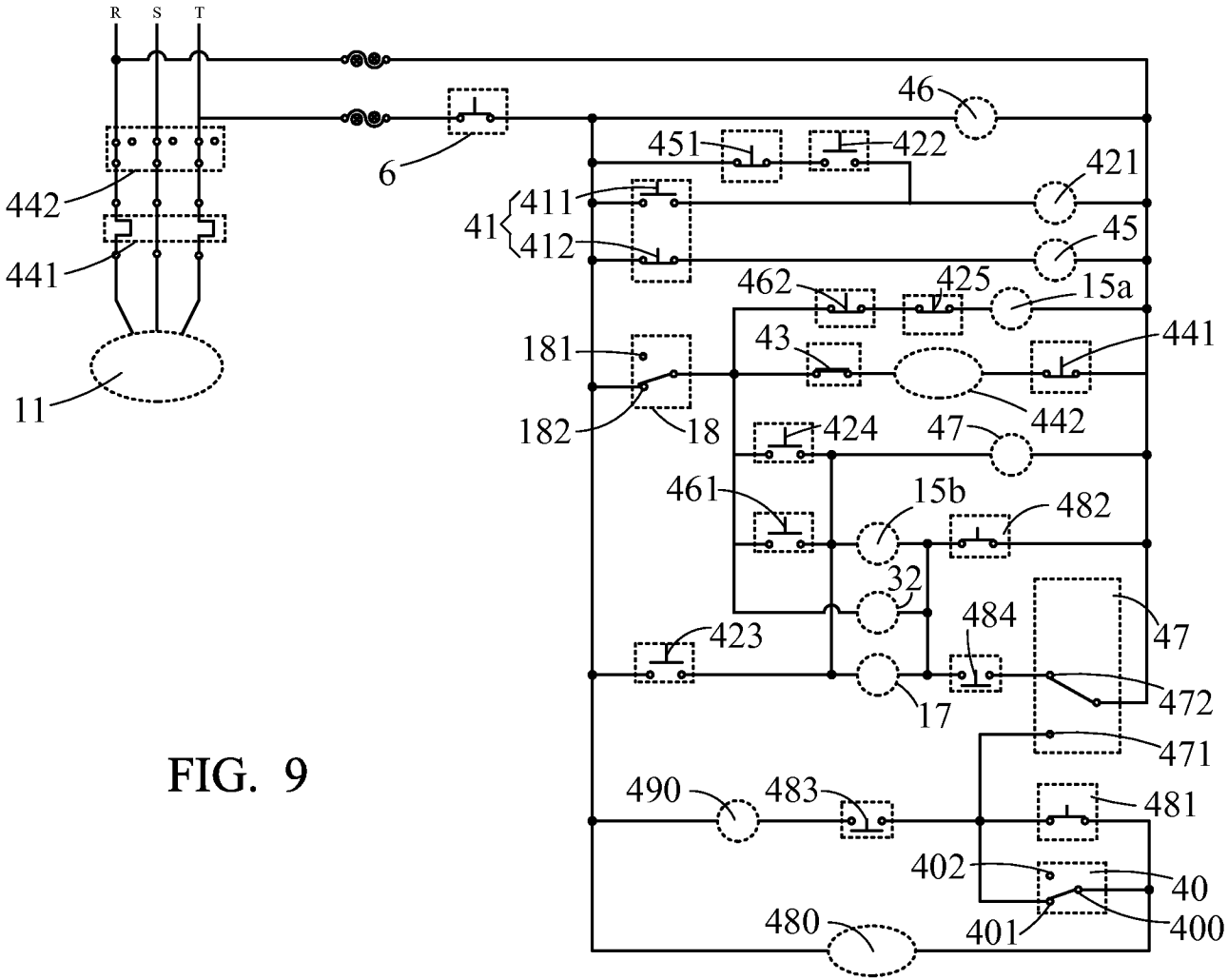
FIG. 9 is a view of the circuitry of the refrigerating machine according to the present invention, wherein the air-cooled evaporator is working after defrosting.

With reference to FIGS. 1 and 9, if the period of time set by the defrosting timer 47 is 15 minutes, the defrosting timer 47 shall become non-conductive 15 minutes later. However, in a case that the defrosting operation is completed in 5 minutes due to small amount of frost in the refrigerating chamber 5, the defrosting timer 47 will not immediately become non-conductive. Instead, the defrosting timer 47 remains conductive for the rest 10 minutes and then turns into non-conductive such that the second contact 482 becomes conductive to reactivate the air-cooled evaporator 3 to produce cold energy for heat exchange. When the defrosting resetting temperature switch 40 detects that the defrosting operation on the air-cooled evaporator 3 is completed, the first contact 401 of the defrosting resetting temperature switch 40 becomes conductive, and the second contact 402 of the defrosting resetting temperature switch 40 becomes non-conductive. At the same time, the coil 480 of the defrosting conversion contactor is energized to make the third and fourth contacts 483 and 484 of the defrosting conversion contactor become non-conductive, and the first and second contacts 481 and 482 of the defrosting conversion contactor become conductive. The air-cooled evaporator 3 is reactivated to produce cold energy for heat exchange. After the air-cooled evaporator 3 has produced cold energy for heat exchange for several minutes, the defrosting resetting temperature switch 40 turns the first contact 401 into non-conductive after detecting that the air-cooled evaporator 3 has been reactivated. In this case, since the first and second contacts 481 and 482 are still conductive, the air-cooled evaporator 3 can still produce cold energy for heat exchange. When the defrosting timer 47 becomes non-conductive 15 minutes later, the first contact 471 becomes non-conductive, and the second contact 472 becomes conductive, as shown in FIG. 7. The coil 480 of the defrosting conversion contactor is not energized such that the third and fourth contacts 483 and 484 of the defrosting conversion contactor become conductive. The first and second contacts 481 and 482 of the defrosting conversion contactor become non-conductive, and the air-cooled evaporator 3 produces cold energy for heat exchange.

In view of the foregoing, when the door of the refrigerating chamber 5 is opened, due to operation of the micro switch 41, operation of the tube-cooled evaporator 2 is replaced by the air-cooled evaporator 3, such that the hot air entering the refrigerating chamber 5, the moisture in the hot air, and the water content in the object to be refrigerated will be absorbed by the air-cooled evaporator 3 and freeze into frost. Since the tube-cooled evaporator 2 does not provide cold energy for heat exchange with the hot air entering the refrigerating chamber 5 and the moisture in the hot air, the tube-cooled evaporator 2 will not frost and, thus, provide a thorough, uniform refrigerating effect, increase the refrigerating effect and refrigerating efficiency of the refrigerating machine according to the present invention. Furthermore, the frost on the air-cooled evaporator 3 melts into water during the defrosting operation, and the water is collected by the water pan 34 and then drained via the water draining pipe 35, avoiding the floor of the refrigerating chamber 5 from becoming wet and avoiding injury by the falling frost in the refrigerating chamber 5.

Although specific embodiments have been illustrated and described, numerous modifications and variations are still possible without departing from the scope of the invention. The scope of the invention is limited by the accompanying claims.

The invention claimed is:

1. A refrigerating machine having tube-cooled evaporator & air-cooled evaporator comprising:

refrigerating device including:

a compressor having an output end and an input end;

a condenser including an input end, an output end and a fan;

a first pipe in communication with and located between the output end of the compressor and the input end of the condenser;

a reservoir including an inlet and an outlet;

a heat exchanger including an input pipe and an output pipe, with the output pipe of the heat exchanger being in communication with the input end of the compressor;

a second pipe;

a first refrigerating electromagnetic valve mounted on the second pipe;

a first expansion valve mounted on the second pipe and located downstream of the first refrigerating electromagnetic valve;

a tube-cooled evaporator in communication with a downstream end of the first expansion valve;

a fifth pipe in communication with a downstream end of the tube-cooled evaporator, with the input pipe of the heat exchanger being in communication with the fifth pipe;

a third pipe in communication with the second pipe and located upstream of the first refrigerating electromagnetic valve;

a second refrigerating electromagnetic valve mounted on the third pipe;

a second expansion valve mounted on the third pipe and located downstream of the second refrigerating electromagnetic valve;

an eighth pipe in communication with a downstream end of the second expansion valve;

an air-cooled evaporator in communication with a downstream end of the eighth pipe;

a fourth pipe in communication with a downstream end of the air-cooled evaporator and the fifth pipe; and an in-chamber temperature switch having a first contact and a second contact, wherein the inlet of the reservoir is in communication with the output end of the condenser, the outlet of the reservoir is in communication with the second pipe; and a defroster including:

a micro switch having a first contact and a second contact;

a door-opening relay including a coil, a first contact, a second contact, a third contact, and a fourth contact;

a high/low pressure switch;

a compressor electromagnetic switch including an overload protector and a coil electrically connected to the overload protector;

a delay relay having a contact;

a set timer having a first contact and a second contact;

a defrosting timer having a first contact and a second contact;

a defrosting conversion contactor including a coil, a first contact, a second contact, a third contact, and a fourth contact;

a seventh pipe;

a defrosting electromagnetic valve mounted on the seventh pipe;

a defrosting resetting temperature switch having a fixed contact, a first contact, and a second contact, wherein the micro switch is mounted in an entrance of a refrigerating chamber, the first contact of the micro switch is electrically connected to the coil of the door-opening relay, the first contact of the door-opening relay, the contact of the delay relay, and the second contact of the door-opening relay, wherein the second contact of the micro switch is electrically connected to the delay relay and the contact of the delay relay, wherein the contact of the delay relay is electrically connected to the first contact of the door-opening relay, wherein the second contact of the door-opening relay is electrically connected to the second refrigerating electromagnetic valve, the fan of the condenser, the third contact of the door-opening relay, the first contact of the set timer, the defrosting timer, the defrosting electromagnetic valve, and the coil of the defrosting conversion contactor, wherein the third contact of the door-opening relay is electrically connected to the first contact of the set timer, the second contact of the set timer, a plurality of fans of the air-cooled evaporator, the high/low pressure switch, and the in-chamber temperature switch, wherein the second contact of the set timer is electrically connected to the fourth contact of the door-opening relay, and the fourth contact of the door-opening relay is electrically connected to the first refrigerating electromagnetic valve, wherein the high/low pressure switch is electrically connected to the in-chamber temperature switch, the third contact of the door-opening relay, the coil of the compressor electromagnetic switch, and the overload protector, wherein the first contact of the defrosting timer is electrically connected to the first contact of the defrosting resetting temperature switch, the first contact of the defrosting conversion contactor, and the third contact of the defrosting conversion contactor, wherein the second contact of the defrosting timer is electrically connected to the fourth contact of the defrosting conversion contactor, wherein the first contact of the defrosting conversion contactor is electrically connected to the fixed contact of the defrosting resetting temperature switch, the first contact of the defrosting resetting temperature switch, and the third contact of the defrosting resetting temperature switch, wherein the second contact of the defrosting conversion contactor is electrically connected to the second refrigerating magnetic valve, the fan of the condenser, the plurality of fans of the air-cooled evaporator, and the fourth contact of the defrosting conversion contactor, wherein the third contact of the defrosting conversion contactor is electrically connected to the defrosting magnetic valve, wherein the coil of the defrosting conversion contactor is electrically connected to the fixed contact of the defrosting resetting temperature switch and the first contact of the defrosting conversion contactor, wherein the seventh pipe including a first end located between the compressor and the condenser and a second end in communication with the eighth pipe connected between the second expansion valve and the air-cooled evaporator.

2. The refrigerating machine having tube-cooled evaporator & air-cooled evaporator as claimed in claim 1, further comprising: a manual selection switch mounted between the coil of the compressor electromagnetic switch and the micro switch, the coil of the door-opening relay, the high/low pressure switch, the delay relay, the set timer, the defrosting timer, the defrosting conversion contactor, the defrosting electromagnetic valve, and the in-chamber temperature switch.

3. The refrigerating machine having tube-cooled evaporator & air-cooled evaporator as claimed in claim 2, with the heat exchanger including a closed container having an outer barrel and an inner barrel fixed inside the outer barrel, with the outer barrel including an inlet tube in communication with the outlet end of the reservoir, with the outer barrel further including an outlet tube in communication with the first and second expansion valves, with the inner barrel including the input pipe in communication with the fifth pipe, with the inner barrel further including the output pipe in communication with the input end of the compressor.

4. The refrigerating machine having tube-cooled evaporator & air-cooled evaporator as claimed in claim 3, with the tube-cooled evaporator including a tube, a plurality of radially spaced fins integrally formed on an outer periphery of the tube, and a bracket, with the tube or the plurality of radially spaced fins fixed by the bracket to an inner top face of the refrigerating chamber.

5. The refrigerating machine having tube-cooled evaporator & air-cooled evaporator as claimed in claim 3, with the air-cooled evaporator including a tank fixed to an inner top face of the refrigerating chamber, the plurality of fans fixed to the tank, a row of copper pipes mounted in the tank, and a water pan mounted to a bottom of the tank, with a water draining pipe mounted to the water pan.

6. The refrigerating machine having tube-cooled evaporator & air-cooled evaporator as claimed in claim 4, with the tube-cooled evaporator further including:

a sixth pipe in communication with and located between the first refrigerating electromagnetic valve on the second pipe and the first expansion valve;

a third expansion valve mounted on a downstream end of the sixth pipe; and a first tube-cooled evaporator in communication with a downstream end of the third expansion valve, with the first tube-cooled evaporator including a tube, a plurality of radially spaced fins integrally formed on an outer periphery of the tube, and a bracket, with the tube or the plurality of radially spaced fins fixed by the bracket to an inner top face of the refrigerating chamber, with the tube of the first tube-cooled evaporator including an end in communication with the downstream end of the third expansion valve, with the tube of the first tube-cooled evaporator including another end in communication with the fifth pipe.

7. The refrigerating machine having tube-cooled evaporator & air-cooled evaporator as claimed in claim 5, with the tube-cooled evaporator further including:

a sixth pipe in communication with and located between the first refrigerating electromagnetic valve on the second pipe and the first expansion valve;

a third expansion valve mounted on a downstream end of the sixth pipe; and a first tube-cooled evaporator in communication with a downstream end of the third expansion valve, with the first tube-cooled evaporator including a tube, a plurality of radially spaced fins integrally formed on an outer periphery of the tube, and a bracket, with the tube or the plurality of radially spaced fins fixed by the bracket to an inner top face of the refrigerating chamber, with the tube of the first tube-cooled evaporator including an end in communication with the downstream end of the third expansion valve, with the tube of the first tube-cooled evaporator including another end in communication with the fifth pipe.

* * * * *